US005773929A

United States Patent [19]

Shi et al.

[11] Patent Number: 5,773,929

[45] Date of Patent: Jun. 30, 1998

[54] ORGANIC EL DEVICE WITH DUAL DOPING LAYERS

[75] Inventors: Song Q. Shi, Phoenix, Ariz.; Hsing-Chung Lee, Calabasas, Calif.; Franky So, Tempe, Ariz.

[73] Assignee: Motorola, Inc., Schaumburg, Ill.

[21] Appl. No.: 669,206

[22] Filed: Jun. 24, 1996

[51] Int. Cl.[6] ..... H01B 33/14

[52] U.S. Cl. ..... 313/504; 313/506

[58] Field of Search ..... 313/502, 503, 313/504, 506

[56] References Cited

U.S. PATENT DOCUMENTS 5,247,226 9/1993 Sato et al. ..... 313/504

*Primary Examiner*—Ashok Patel
*Assistant Examiner*—Vip Patel
*Attorney, Agent, or Firm*—Eugene A. Parsons

[57] ABSTRACT

An organic light emitting device is positioned on an optically transmissive supporting substrate and includes a layer of ITO positioned on a planar surface of the substrate. A layer of hole transporting material with fluorescent dye molecules as fluorescent centers is supported on the layer of ITO, directly or with other layers, e.g. a hole injecting layer, therebetween. A layer of electron transporting material with fluorescent dye molecules as fluorescent centers is positioned on the hole transporting material and a layer of low work function metal is positioned on the layer of electron transporting material.

9 Claims, 1 Drawing Sheet

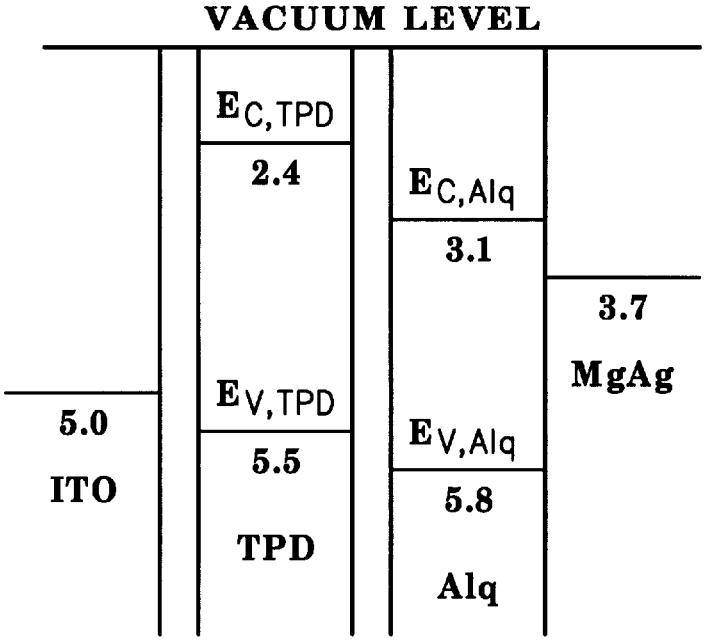
FIG. 1 - PRIOR ART -
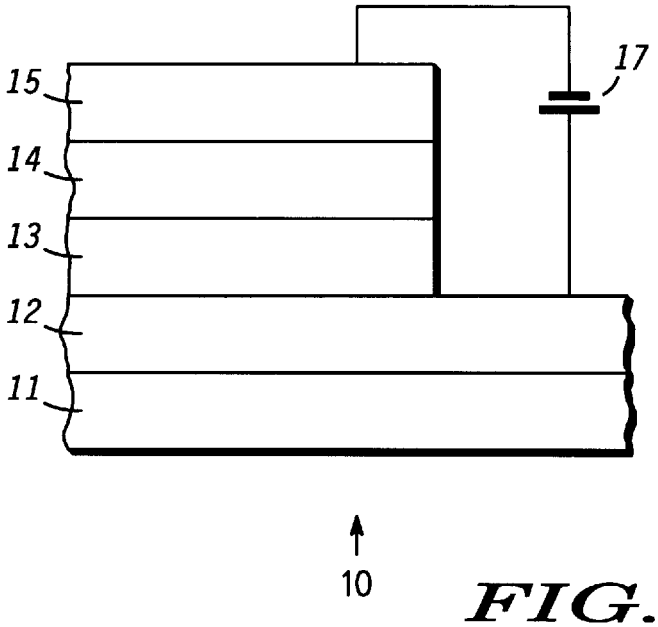
FIG. 2

ORGANIC EL DEVICE WITH DUAL DOPING LAYERS

FIELD OF THE INVENTION

This invention relates to an organic electroluminescence (EL) devices and particularly to multi-layer organic EL devices.

BACKGROUND OF THE INVENTION

Organic electroluminescent (EL) devices are generally composed of three layers of organic molecules sandwiched between transparent and metallic electrodes, the three layers including an electron transporting layer, an emissive layer and a hole transporting layer.

There are several variations in organic EL structures depending on where the emissive layer is positioned. Tsutsui and coworkers proposed three EL cell structures: an SH-A cell, an SH-B cell and a DH cell(T. Tsutsui, et. al, Photochem. Processes Organ. Mol. Syst., Proc. Meml. Conf. Late Professor Shigeo Tazuke, 437–50 (1991)). The SH-A cell is successively composed of a layer of Mg—Ag as a cathode, an electron transporting layer, a hole transporting layer and a layer of Indium-Tin-oxide (ITO) as an anode, wherein the part of the electron transporting layer close to the hole transporting layer is doped with an efficient, thermal stable, fluorescent dye as an emitter. The SH-B cell is also successively composed of a layer of Mg—Ag as a cathode, an electron transporting layer, a hole transporting layer and a layer of ITO as an anode, wherein the part of the hole transporting layer close to the electron transporting layer is doped with an efficient, thermal stable, fluorescent dye as an emitter. The DH cell is successively composed of a layer of Mg—Ag as a cathode, an electron transporting layer, an emitter layer, a hole transporting layer and a layer of ITO as an anode, wherein the emitter layer is an independent layer sandwiched between the electron transporting layer and the hole transporting layer.

Early in U.S. Pat. No. 4,539,507, VanSlyke and Tang also disclosed a SH-A type of organic EL device with a hole-injecting zone and an organic luminescent zone wherein the luminescent zone is an electron transporting compound, and has a quantum efficiency of at least 0.05% and a w/w efficiency of at least $9\times10^{-5}$, and a thickness of less then 1 um.

It is an objective of the present invention to provide a new and improved organic EL device.

It is another objective of the present invention to provide an organic EL device where additional layer is doped with a fluorescent dye.

It is another objective of the present invention to provide an organic EL device which has high brightness and efficiency.

SUMMARY OF THE INVENTION

The above problems and others are at least partially solved and the above purposes and others are realized in an organic electroluminescence device including a first conductive layer having a first type of conductivity, a layer of first carrier transporting material doped with a fluorescent dye molecules as fluorescent centers supported on the first conductive layer, a layer of second carrier transporting material doped with a fluorescent dye molecules as fluorescent centers positioned on the first carrier transporting material, and a second conductive layer having a second type of conductivity supported on the layer of second carrier transporting material.

According to the present invention, there is obtained an organic EL device with efficient light emission from the first carrier transporting material layer and the second carrier transporting material layer when the device is under bias.

BRIEF DESCRIPTION OF THE DRAWING

Referring to the drawings:

FIG. 1 is a schematic band diagram for all the layers constituting a typical organic EL device with cell structure of ITO//TPD//Alq//MgAg; and FIG. 2 is a simplified sectional view of an organic electroluminescence device in accordance with the present invention.

DESCRIPTION OF THE PREFERRED EMBODIMENTS

In the prior art, Aluminum tris(8-quinolinol) (Alq) has often been used in electron transporting layers as an electron transporting material, while an aromatic diamine such as N,N'-diphenyl-N,N'-bis(3-methylphenyl)-[1,1'-biphenyl]-4,4'-diamine (TPD) has often been used in hole transporting layers as a hole transporting material. A schematic band diagram for all the layers constituting a typical organic EL device in the prior art is shown in FIG. 1.

The typical organic EL device includes a layer of MgAg (at the right of the band diagram), a layer of Alq, a layer of TPD, and a layer of ITO (the left hand of the band diagram). The energy barrier for electron injection from the conduction band ($E_{c,Alq}$) of the Alq layer to the conduction band ($E_{C,TPD}$) of the TPD layer is about 0.7 eV, while the energy barrier for hole injection from the valence band ($E_{V,TPD}$) of the TPD layer to the valence band ($E_{V,Alq}$) of the Alq layer is about 0.3 eV. Therefore, holes are more easily injected into the Alq layer, and electrons are more likely accumulated in the part of Alq layer close to the Alq/TPD interface. Consequently, the emission occurs in the part of the Alq layer close to the Alq/TPD interface where electrons and holes recombine.

Since the Alq layer is doped with a fluorescent dye in the part close to the Alq/TPD interface where recombination usually occurs, a SH-A type of organic EL device is generally more efficient than the corresponding SH-B type of organic EL device, which is doped with a fluorescent dye in the part of the TPD layer close to the Alq/TPD interface. In fact, presently most of the organic EL devices that have both efficiency and reliability good enough to be useful for practical backlight or display applications have an SH-A type of cell structure.

Hamada and coworker in 1995 reported a modified SH-B type of organic EL cell (Y. Hamada et. al, Jpn. J. Appl. Phys. 34 (1995), L824–L826) with Rubrene as a dopant. The device has a luminance of 1020 cd/m2 at a current density of 10 mA/cm2 and a half lifetime of 3554 hour with initial luminance of 500 cd/m2, which is a substantial improvement over any prior known SH-B type of cells.

It is believed that the success of Hamada's work indicates that there are electrons which overcame the barrier and got into the TPD layer from the Alq layer, though the energy barrier for electron injection from the conduction band ($E_{c,Alq}$) of the Alq layer to the conduction band ($E_{C,TPD}$) of the TPD layer is higher than that for hole injection from the valence band ($E_{V,TPD}$) of the TPD layer to the valence band ($E_{v,Alq}$) of the Alq layer. The efficiency of an organic EL device can be improved, if those electrons which get into the TPD layer from the Alq layer can be used to emit light.

The present invention is directed to an organic light emitting device which, in general, consist of thin layers of organic molecules sandwiched between transparent and metallic electrodes. FIG. 2 illustrates in a simplified cross-sectional view, one embodiment of an organic EL device 10. Organic EL device 10 includes a transparent substrate 11 which in this specific embodiment is a glass or plastic plate having a relatively planar upper surface. A transparent electrically conductive layer 12 is positioned on the planar surface of substrate 11 so as to form a relatively uniform electrical contact. A first carrier transporting layer 13 made of organic first carrier transporting materials is positioned on the surface of conductive layer 12. Then a second carrier transporting layer 14 made of organic second carrier transporting materials is positioned on the surface of 13 and a second electrically conductive layer 15 is positioned on the upper surface of transporting layer 14 to form a second electrical contact.

In this specific embodiment, the conductive layer 12 is formed of transparent organic or inorganic conductors, such as conductive polyaniline (PANI) or indium-tin-oxide (ITO), zinc oxide (ZnOx), vanadium oxide (VOx), molybdenum oxide (MoOx) and ruthenium oxide (RuOx) which are substantially transparent to visible light. The conductive layer 15 is formed of any of a wide range of metals or alloys in which at least one metal has a work function less than 4.0 eV. The low work function metals include lithium, magnesium, calsium, etc. By the proper selection of material for conductive layer 15, the work functions of the materials making up layers 14 and 15 are substantially matched to reduce the required operating voltage and improve the efficiency of organic EL device 10. In practice, on top of the low work function metal is deposited a thick layer of stable metal, such as silver, aluminum, indium, or gold, to act as a barrier to moisture and/or oxygen which are detrimental to the low work function metal and organic EL device 10 as a whole.

In this specific embodiment, for example only, the first carriers are holes and the second carriers are electrons. Thus the first carrier transporting layer 13 is made of organic hole transporting materials, while the second carrier transporting layer 14 is made of organic electron transporting materials.

Further, in this embodiment, the whole or a part of hole transporting layer 13 is doped with a fluorescent dye and the whole or a part of electron transporting layer 14 is doped with a fluorescent dye. When a potential is applied between layers 12 and 15 by means of a potential source 17, electrons are injected from layer 15 into electron transporting layer 14 and hole transporting layer 13, and holes are injected from layer 12 into hole transporting layer 13 and electron transporting layer 14 where, upon electron and hole recombination, a photon is emitted. Therefore light emission from both electron transporting layer 14 and hole transporting layer 13 occurs. The percentage of light emission from electron transporting layer 14 and hole transporting layer 13 is determined by the aoolied electric filed as well as the relative band alignment of the materials constituting electron transporting layer 14 and hole transporting layer 13.

It is essential that the fluorescent dye material capable of emitting light in response to hole-electron recombination should have a bandgap no greater than that of the materials making up the hole transport layer and the electron transport layer. It is preferred that the fluorescent dye molecules are present in both the electron transport layer and the hole transport layer in a concentration of from $10_{-3}$ to 10 mole percent, based on the moles of the materials included in the hole transport layer and electron transport layer. The proper selection of a fluorescent dye to achieve a desirable emission color as well as an organic EL device with longevity is well known to those skilled in the art.

Generally, hole transporting layer 13 is composed of hole transporting materials, such as aromatic tertiary amines disclosed in U.S. Pat. No. 5,061,569 and 5,256,945. The electron transporting layer is formed of electron transporting materials, such as organo-metallic complexes disclosed in U.S. Pat. No. 4,539,507 and a pending U.S. patent application entitled "NEW ORGANOMETALLIC COMPLEXES FOR USE IN LIGHT EMITTING DEVICES", filed 12 Sep. 1994, bearing Ser. No. 08/304,451, and assigned to the same assignee.

In one variation of the embodiment, a thin layer, preferably less than 500 Å thick, of hole injecting material is inserted between layer 12 (anode) and hole transporting layer 13 to enhance the hole injection from the anode in organic EL device 10. Any porphyrinic compounds disclosed in U.S. Pat. No. 3,935,031 or U.S. Pat. No. 4,356,429 can be employed as the hole injecting layer.

In another variation of the embodiment, a thin layer, preferably less than 600 Å thick, of electron injecting material is inserted between layer 15 (cathod) and electron transporting layer 14 to improve the electron injection from the cathod in organic EL device 10.

Thus, an organic electroluminescence device with dual doping layers is disclosed. The improved organic EL device has fluorescent dye molecules distributed in both the hole transporting layer and the electron transporting layer. Thus, there is obtained an organic EL device with efficient light emission from the first carrier transporting material layer and the second carrier transporting material layer when the device is under bias. The organic EL device offers improved luminous efficiency and high light output (luminance).

While we have shown and described specific embodiments of the present invention, further modifications and improvements will occur to those skilled in the art. I desire it to be understood, therefore, that this invention is not limited to the particular forms shown and I intend in the appended claims to cover all modifications that do not depart from the spirit and scope of this invention.

What is claimed is:

1. An organic light emitting device comprising:

a first conductive layer having a first type of conductivity;

a layer of first carrier transporting material with fluorescent dye molecules as fluorescent centers supported on the first conductive layer;

a layer of second carrier transporting material with fluorescent dye molecules as fluorescent centers positioned on the first carrier transporting material; and a second conductive layer having a second type of conductivity supported on the layer of second carrier transporting material.

2. An organic light emitting device as claimed in claim 1 wherein the fluorescent dye molecules have a bandgap no greater than that of the materials making up the first and the second carrier transport layers.

3. An organic light emitting device as claimed in claim 1 wherein the fluorescent dye molecules are present in the first and second carrier transport layers in a concentration of from $10^{-3}$ to 10 mole percent, based on the moles of the materials included in the first and second transport layer.

4. An organic light emitting device as claimed in claim 1 wherein the first carriers are holes and the second carriers are electrons.

5. An organic light emitting device as claimed in claim 1 wherein one of the first and second conductive layers are transparent to light emitted by the first and second carrier transporting layers.

6. An organic light emitting device as claimed in claim 1 including additional layers of material supported between the first and second conductive layers and the first and second carrier transporting layers.

7. An organic light emitting device as claimed in claim 6 wherein the additional layers of materials include a first carrier injection layer and/or a second carrier injection layer.

8. An organic light emitting device comprising:

a first conductive layer having p-conductivity;

a layer of hole transporting material with fluorescent dye molecules as fluorescent centers supported on the first conductive layer;

a layer of electron transporting material with fluorescent dye molecules as fluorescent centers positioned on the hole transporting material; and a second conductive layer having n-conductivity supported on the layer of electron transporting material.

9. An organic light emitting device comprising:

an optically transmissive supporting substrate;

a layer of indium-tin-oxide positioned on a planar surface of the substrate;

a layer of hole transporting material with fluorescent dye molecules as fluorescent centers supported on the layer of indium-tin-oxide;

a layer of electron transporting material with fluorescent dye molecules as fluorescent centers positioned on the hole transporting material; and a layer of low work function metal positioned on the layer of electron transporting material.

* * * * *